US006905272B2

(12) United States Patent
Yamanaka

(10) Patent No.: US 6,905,272 B2
(45) Date of Patent: Jun. 14, 2005

(54) CASE

(75) Inventor: Yasuhiro Yamanaka, Higashi-Osaka (JP)

(73) Assignee: M.F.V Co., Ltd., Higashi-Osaka (JP)

( * ) Notice: Subject to any disclaimer, the term of this patent is extended or adjusted under 35 U.S.C. 154(b) by 161 days.

(21) Appl. No.: 10/620,463

(22) Filed: Jul. 17, 2003

(65) Prior Publication Data

US 2004/0020811 A1 Feb. 5, 2004

(30) Foreign Application Priority Data

Jul. 30, 2002 (JP) ..... 2002-222069

(51) Int. Cl.[7] ..... A45D 40/04

(52) U.S. Cl. ..... 401/70; 401/68; 401/75; 401/86

(58) Field of Search ..... 401/68–71, 75–78, 401/132, 86, 88; 222/390, 153.13; 206/581, 823, 807, 385, 459.1

(56) References Cited

U.S. PATENT DOCUMENTS

| | | | | | |
|---|---|---|---|---|---|
| 2,818,973 | A | * | 1/1958 | Croce et al. | 401/75 |
| 3,771,881 | A | * | 11/1973 | Swenson | 401/75 |
| 5,275,496 | A | * | 1/1994 | Fattori et al. | 401/68 |
| 5,868,510 | A | * | 2/1999 | Lacout et al. | 401/70 |
| 5,879,096 | A | * | 3/1999 | Franta et al. | 401/75 |
| 5,967,683 | A | * | 10/1999 | Fattori | 401/68 |
| 6,086,276 | A | * | 7/2000 | Gueret | 401/54 |
| 6,190,074 | B1 | * | 2/2001 | Demellier et al. | 401/78 |
| 6,435,748 | B1 | * | 8/2002 | Taghikhani | 401/68 |
| 2004/0069814 | A1 | * | 4/2004 | Hemming et al. | 222/390 |

FOREIGN PATENT DOCUMENTS

| | | | | |
|---|---|---|---|---|
| FR | 2657822 | A1 * | 8/1991 | A45D/40/06 |
| JP | 58-14889 | | 3/1983 | |
| JP | 2001-128733 | | 5/2001 | |

* cited by examiner

*Primary Examiner*—Khoa D. Huynh
(74) *Attorney, Agent, or Firm*—Oblon, Spivak, McClelland, Maier & Neustadt, P.C.

(57) ABSTRACT

A case for lipstick or lip cream or the like has a tubular casing, a contents carrying unit including a carrier movably disposed in the tubular casing, and a rotary control unit including a rotary member for moving the carrier by rotating the rotary member, which is capable of protruding and retracting contents from and into the tubular casing smoothly by rotating the rotary member, reducing number of parts for constituting the case and manufacturing cost, and at the same time simplifying the assembly of the rotary member and the carrier to the tubular casing. The rotary control unit and the contents carrying unit are molded integrally with a breaking portion interposed therebetween so that the rotary control unit and the contents carrying unit are separated when the carrier is moved away from the rotary member by rotating the rotary member.

9 Claims, 14 Drawing Sheets

PRIOR ART

PRIOR ART

CASE

BACKGROUND OF THE INVENTION

This invention relates to a case for lipstick or lip cream or the like.

Cases for containing lipstick or lip cream or the like include those which have, as shown in FIG. 18, a tubular casing 51, a carrier 53 for carrying contents 52 received and held movably in the tubular casing 51, and a rotary member 54 held rotatably with respect to the tubular casing 51. The rotary member 54 is provided with a screw shaft 55 projecting therefrom, and the carrier 53 is provided with a threaded tube 56 by which the carrier 53 is screwed onto the screw shaft 55, so that a rotary operation of the rotary member 54 causes the carrier 53 carrying the contents 52 to move inside the tubular casing 51 to protrude and retract the contents 52, which is lipstick or lip cream or the like, from and into the tubular casing 51 (for example JP-UM-B-58-14889).

However, in this kind of case of related art, since a rotary control unit including the rotary member 54 and a contents carrying unit including the carrier 53 carrying the contents 52 are separately constructed, an increased number of parts are required to constitute the case and, hence, numerous molds for forming these parts are needed, which results in an increased manufacturing cost. Moreover, the separately constructed rotary control unit and contents carrying unit each have to be individually assembled to the tubular casing 51, which requires complicated assembly of the parts.

There have also been cases, as shown in FIG. 19, in which the rotary member 54 and the carrier 53 are connected through a connecting member 59 which can fold at a plurality of fold lines to contract or extend adjustably, whereby the rotary member 54 and the carrier 53 can be integrally molded (JP-A-2001-128733).

In this case, however, there have been problems that the rotation of the rotary member 54 can not be transmitted well to the carrier 53, the carrier 53 cannot be moved smoothly in the tubular casing 51 by a rotary operation of the rotary member 54, and the contents 52 carried on the carrier 53 cannot be smoothly protruded from and retracted into the tubular casing 51.

SUMMARY OF THE INVENTION

Accordingly, it is an object of the present invention to provide a case capable of protruding and retracting contents from and into a tubular casing smoothly by rotating a rotary member, reducing number of parts constituting the case and its manufacturing cost, and at the same time simplifying the assembly of the rotary member and a carrier and so on to the tubular casing.

As a technical means to achieve these objects, the invention provides a case having a tubular casing 2; a contents carrying unit including a carrier 4 movably disposed in the tubular casing 2; a rotary operation unit including a rotary member 5 for moving the carrier 4 in the tubular casing by rotating the rotary member 5, wherein the rotary control unit and the contents carrying unit are integrally formed with a breaking portion 24 interposed therebetween so that the rotary control unit and the contents carrying unit are separated when the carrier 4 is moved away from the rotary member 5 by rotating the rotary member 5.

In this arrangement, for example, the case may have a tubular casing 2; a contents carrying unit including a carrier 4 for carrying contents 3 and being movably disposed in the tubular casing 2; and a rotary control unit including a rotary member 5 for moving the carrier 4 in the tubular casing 2 so as to protrude and retract the contents 3 from and into the tubular casing 2 by rotating the rotary member 5, wherein the rotary control unit and the contents carrying unit are integrally formed with a breaking portion 24 interposed therebetween so that the rotary control unit and the contents carrying unit are separated when the carrier 4 is moved away from the rotary member 5 by rotating the rotary member 5.

Another technical means of the invention is a screw shaft 6 provided on one of the rotary member 5 and the carrier 4 so as to project therefrom, and a screw leg 7 provided on the other so as to extend therefrom beside the screw shaft 6, the screw leg 7 having a female thread 27 to be meshed with a male thread 26 formed on the screw shaft 6, so that when the rotary member is rotated, the screw shaft 6 is rotated with respect to the screw leg 7, which causes the screw leg 7 to move with respect to the screw shaft 6 in a lengthwise direction of the tubular casing 2, thereby moving the carrier 4 inside the tubular casing 2.

Another technical means of the invention is in that a plurality of such screw legs 7 are provided around the screw shaft 6, and when the carrier 4, the screw shaft 6 and the screw legs 7 are inserted into the tubular casing 2, the screw legs 7 are pressed against the screw shaft 6 so that the female threads 27 of the screw legs 7 are meshed with the male thread 26 of the screw shaft 6.

Another technical means of the invention is in that the screw legs 7 are provided on the rotary member 5; the screw shaft 6 is provided on the carrier 4; and the screw shaft 6 is breakably connected to the rotary member 5 through a breaking portion 24.

Another technical means of the invention is in that the screw shaft 6 is provided on the rotary member 5, the screw legs 7 are provided on the carrier 4, and the screw shaft 6 is breakably connected to the carrier 4 through a breaking portion 24.

Another technical means of the invention is a locking mechanism 22 provided between the carrier 4 and the tubular casing 2 for preventing the carrier 4 from rotating with respect to the tubular casing 2.

Another technical means of the invention is in that the locking mechanism 22 includes a guide groove 21 provided in one of the outer surface of the carrier 4 and the inner surface of the tubular casing 2, and a guide rib 14 provided on the other, the guide rib 14 being engaged with the guide groove 21 slidably in their length direction to prevent the carrier 4 from rotating with respect to the tubular casing 2.

Another technical means of the invention is an anti-rotation mechanism 30 provided between the screw legs 7 and the tubular casing 2 for preventing the screw legs 7 from rotating with respect to the tubular casing 2.

Another technical means of the invention is in that the anti-rotation mechanism 30 includes engaging projections 28 provided on one of the outer surfaces of the screw legs 7 and the inner surface of the tubular casing 2, and engaging recesses 12 provided on the other, the engaging projections 28 being engaged with the engaging recesses 12 slidably in their length direction to prevent the screw legs 7 from rotating with respect to the tubular casing 2.

DETAILED DESCRIPTION OF THE PREFERRED EMBODIMENTS

Figure 1:
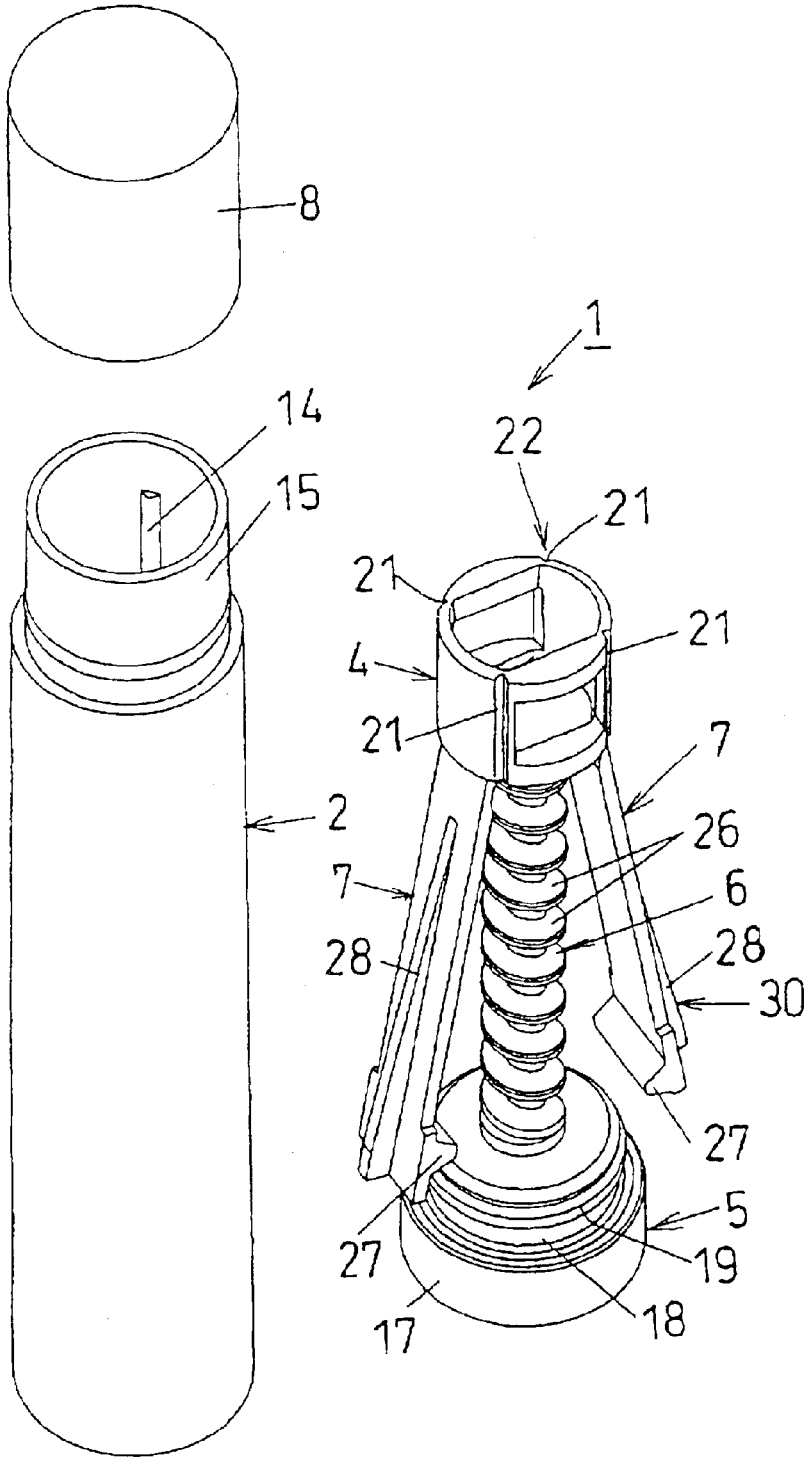
FIG. 1 is an exploded perspective view showing a preferred embodiment of the invention.

The invention will now be described in detail with reference to preferred embodiments illustrated in the accompanying drawings.

In FIG. 1 through FIG. 14, a case 1 for containing lipstick or lip cream or the like has a tubular casing 2, a carrier 4 for carrying contents 3, a rotary member 5, a screw shaft 6, a pair of screw legs 7, and a cap 8, which are made of a hard synthetic resin or the like.

The tubular casing 2 having a shape of a cylindrical tube defines an annular retaining recess 11 in an inner circumferential surface in a base end portion thereof and four engaging recesses 12 arranged with uniform intervals in a circumferential direction thereof (or two on diametrically opposite positions) in a lower half portion of the inner circumferential surface. Each of the engaging recesses 12 extends from the retaining recess 11 to an intermediate position in an axial direction of the tubular casing 2.

The tubular casing 2 is formed on the inner surface thereof with four axially extending guide ribs 14 projecting from the inner surface and being arranged with uniform intervals in the circumferential direction thereof. The guide ribs 14 are disposed at intermediate positions between the engaging recesses 12 in the circumferential direction of the tubular casing 2. The tubular casing 2 is further formed with a cap fitting portion 15 having a reduced diameter and an opening 16 on a top end thereof.

The rotary member 5 is formed in a shape of a cup having a larger-diameter control portion 17 and a smaller-diameter fitting portion 18, and provided with an annular retaining ridge 19 projecting from the fitting portion 18. When the fitting portion 18 of the rotary member 5 fits in the base end portion of the tubular casing 2, the retaining ridge 19 engages the retaining recess 11 of the tubular casing 2, whereby the rotary member 5 is held by the tubular casing 2 rotatably about the axis thereof with its control portion 17 outwardly projected from the base end of the tubular casing 2.

The carrier 4 is formed in a shape of a cylindrical cup and provided with four axially extending guide grooves 21 in an outer circumferential surface thereof at uniform intervals in the circumferential direction thereof. The carrier 4 is fitted inside the tubular casing 2 with the guide ribs 14 of the tubular casing 2 engaged with the guide grooves 21 of the carrier 4, so that the carrier 4 is held in the tubular casing 2 slidably in the axial direction and the guide ribs 14 of the tubular casing 2 and the guide grooves 21 of the carrier 4 constitute a locking mechanism 22 for preventing the carrier 4 from rotating with respect to the tubular casing 2.

The rotary member 5 is formed with a screw shaft 6 projecting therefrom, and the carrier 4 is formed with a pair of screw legs 7 projecting therefrom. The screw shaft 6 is breakably connected to the carrier 4 by a narrow breaking portion (connecting portion) 24. The breaking portion 24 is formed to have a diameter which gradually decreases toward the carrier 4 (or the screw shaft 6), so as to be easily broken. Thus, a rotary control unit including the rotary member 5 and the screw shaft 6; and a contents carrying unit including the carrier 4 and the pair of screw legs 7 are molded integrally.

The pair of screw legs 7 project from the carrier 4 so as to bestride the screw shaft 6 and slope divergently toward the rotary member 5, and each of the screw legs 7 is provided on a distal end thereof with a female thread (inner thread) 27 to be meshed with a male thread 26 of the screw shaft 6. The pair of screw legs 7 are each provided on an outer surface thereof with a lengthwisely extending engaging projection 28. The screw legs 7 are each formed at base end thereof with an elastically deforming portion 29 formed thin so as to be readily deformed elastically toward the screw shaft 6.

When the carrier 4, the screw shaft 6 and the screw legs 7 are inserted into the tubular casing 2, the pair of screw legs 7 are elastically deformed at the elastically deforming portions 29 and are radially inwardly pressed by the inner circumferential surface of the tubular casing 2 so as to approach the screw shaft 6, and held close to the screw shaft 6 with the female threads 27 of the screw legs 7 meshed with the male thread 26 of the screw shaft 6. The engaging projections 28 of the pair of screw legs 7 are lengthwisely slidably engaged with two diametrically opposite engaging recesses 12 of the four engaging recesses 12 of the tubular casing 2. Thus the engaging projections 28 and the engaging recesses 12 constitute an anti-rotation mechanism 30 for preventing the screw legs 7 from rotating with respect to the case 1.

The screw shaft 6 is provided with a stopper 32 at the end thereof on the carrier 4 side. Abutting with this stopper 32, the female threads 27 of the screw legs 7 are prevented from leaving the screw shaft 6, and the movement of the carrier 4 toward the top end opening 16 is limited. This stopper 32 may be omitted.

The cap 8 is removably fitted to the cap fitting portion 15 of the tubular casing 2 to cover the top end opening 16 of the tubular casing 2.

For manufacturing the case 1 according to this preferred embodiment, the tubular casing 2 and the cap 8 are formed as separate parts, and the rotary member 5, the carrier 4, the screw shaft 6, and the pair of screw legs 7 are molded integrally.

Figure 2:
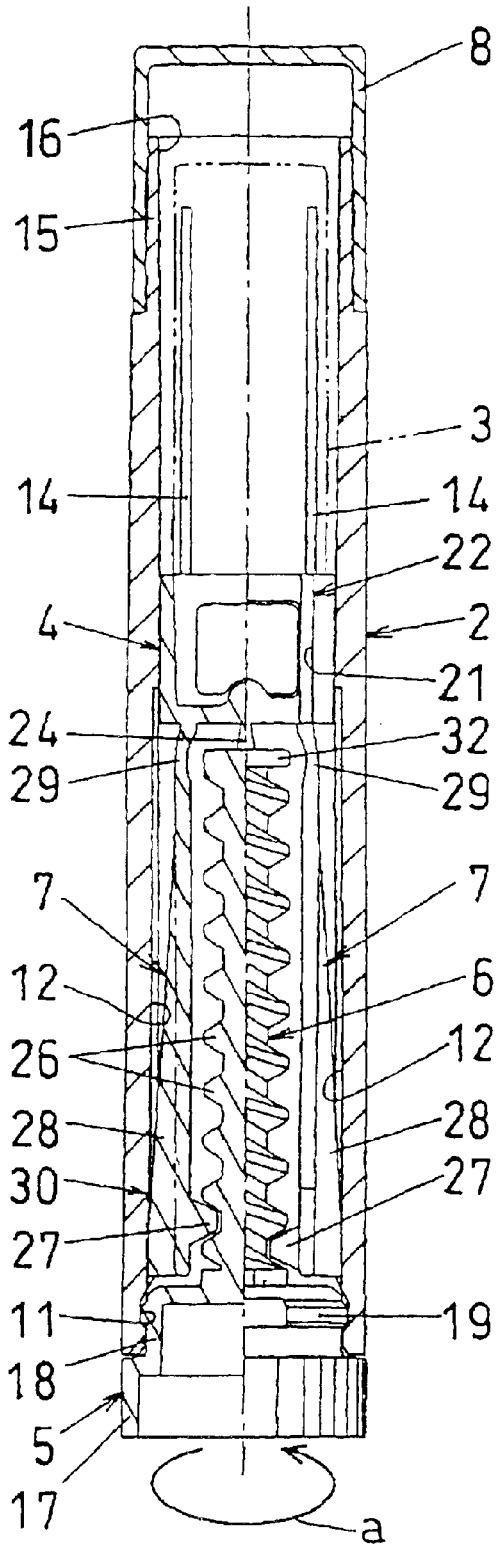
FIG. 2 is a semi-sectional side view of the same.
Figure 3:
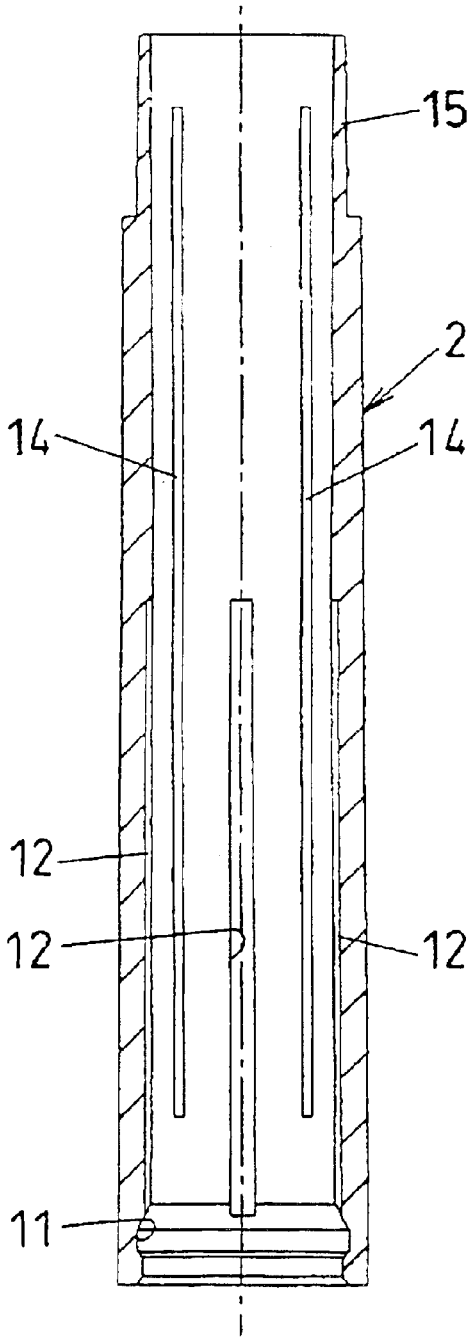
FIG. 3 is a sectional side view of a tubular casing of the same.
Figure 4:
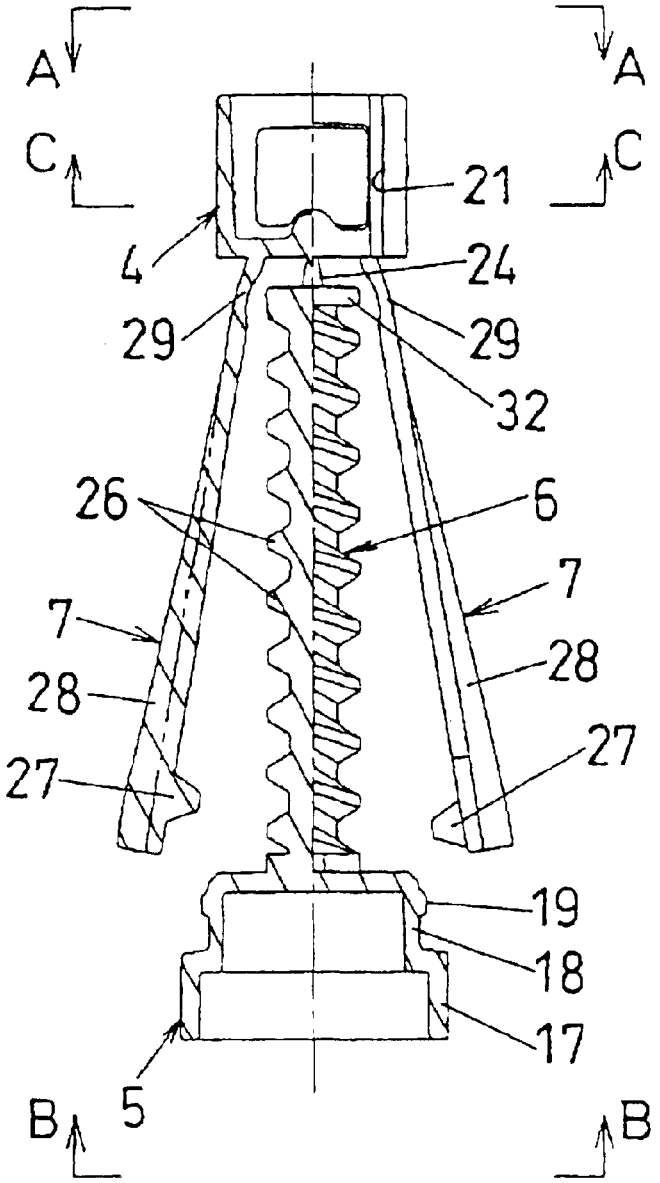
FIG. 4 is a semi-sectional side view of an integrally molded rotary member and carrier of the same.
Figure 5:
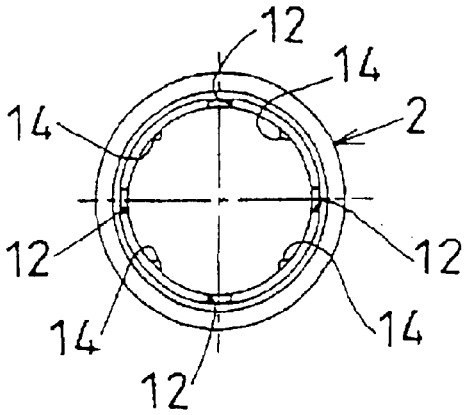
FIG. 5 is a bottom view of the tubular casing.
Figure 6:
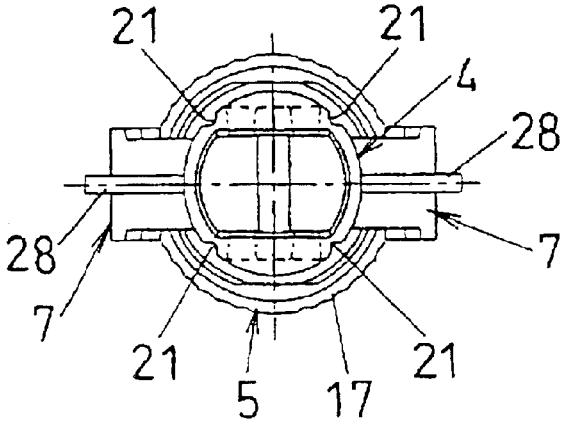
FIG. 6 is a view in the direction of the arrows A—A in FIG. 4.
Figure 7:
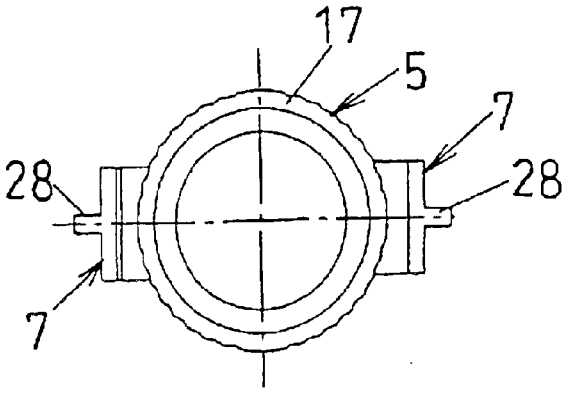
FIG. 7 is a view in the direction of the arrows B—B in FIG. 4.
Figure 8:
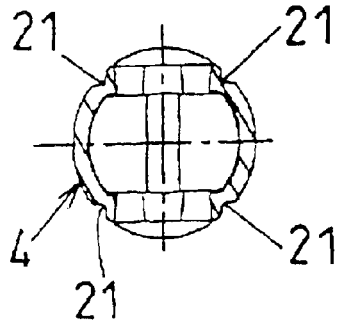
FIG. 8 is a sectional view on the line C—C in FIG. 4.
Figure 9:
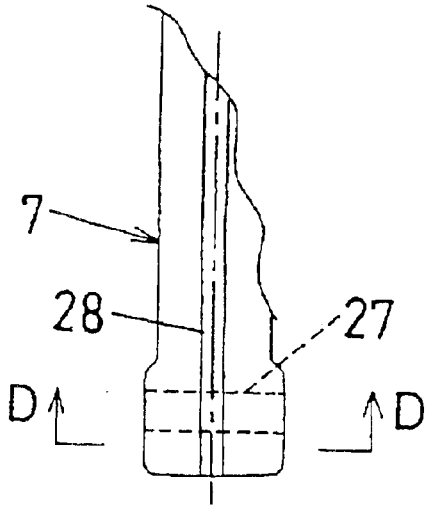
FIG. 9 is a sectional view of a screw leg of the first preferred embodiment.
Figure 10:
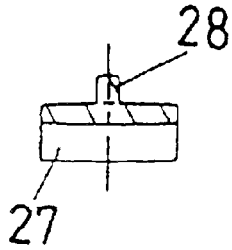
FIG. 10 is a sectional view on the line D—D in FIG. 9.

After the contents 3 is set on the carrier 4 in an outwardly projecting manner, the integrally molded rotary member 5 is rotated with respect to the tubular casing 2 so as to align the guide ribs 14 and the engaging projections 28 with the guide grooves 21 and the engaging recesses 12, respectively, as shown in FIG. 2, and then the integrally molded rotary member 5, carrier 4, screw shaft 6, and the pair of screw legs 7 are inserted into the tubular casing 2 from its base end.

Accordingly, as shown in FIG. 2, the retaining ridge 19 of the rotary member 5 engages the retaining recess 11 of the tubular casing 2, the guide ribs 14 of the tubular casing 2 engage the guide grooves 21 of the carrier 4, and the engaging recesses 12 of the tubular casing 2 engage the engaging projections 28 of the screw legs 7. The pair of screw legs 7 are held close to the screw shaft 6 with the female threads 27 of the screw legs 7 meshed with the male thread 26 of the screw shaft 6.

With this arrangement, when the rotary member 5 is rotated about its axis in the a direction, the rotary member 5 and the screw shaft 6 both rotate in the a direction. Since the engagement of the guide ribs 14 with the guide grooves 21 prevents the carrier 4 from rotating with respect to the tubular casing 2 and the engagement of the engaging recesses 12 with the engaging projections 28 prevents the screw legs 7 from rotating with respect to the tubular casing 2, the screw legs 7 and the carrier 4 cannot rotate and, hence, the rotation of the screw shaft 6 causes the screw legs 7 and the carrier 4 to move toward the top end of the tubular casing 2.

Figure 11:
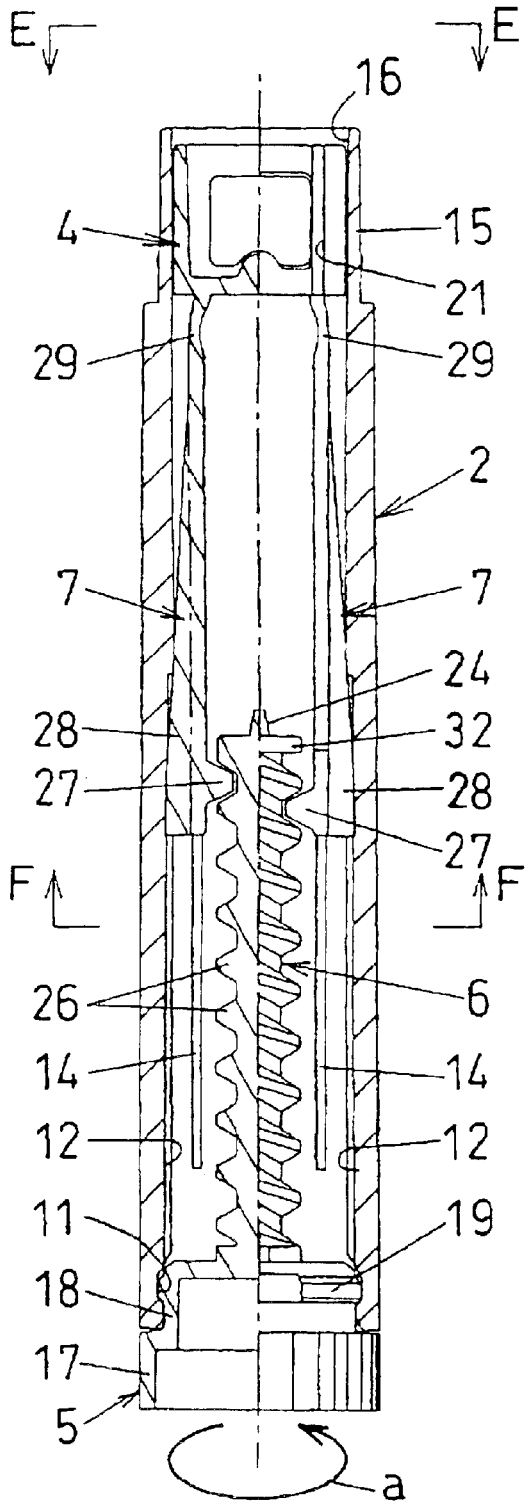
FIG. 11 is a sectional view illustrating a step of assembling the integrally molded rotary member and carrier to the tubular casing.
Figure 12:
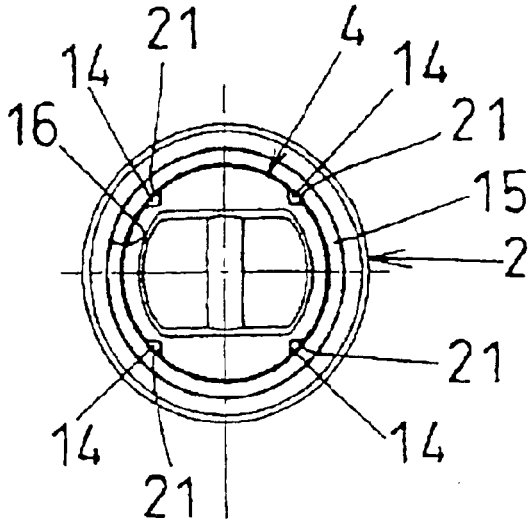
FIG. 12 is a view in the direction of the arrow E—E in FIG. 11.
Figure 13:
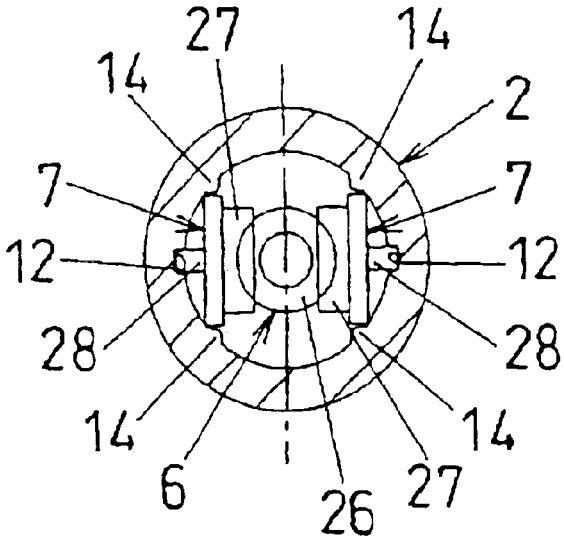
FIG. 13 is a sectional view on the line F—F in FIG. 11.
Figure 14:
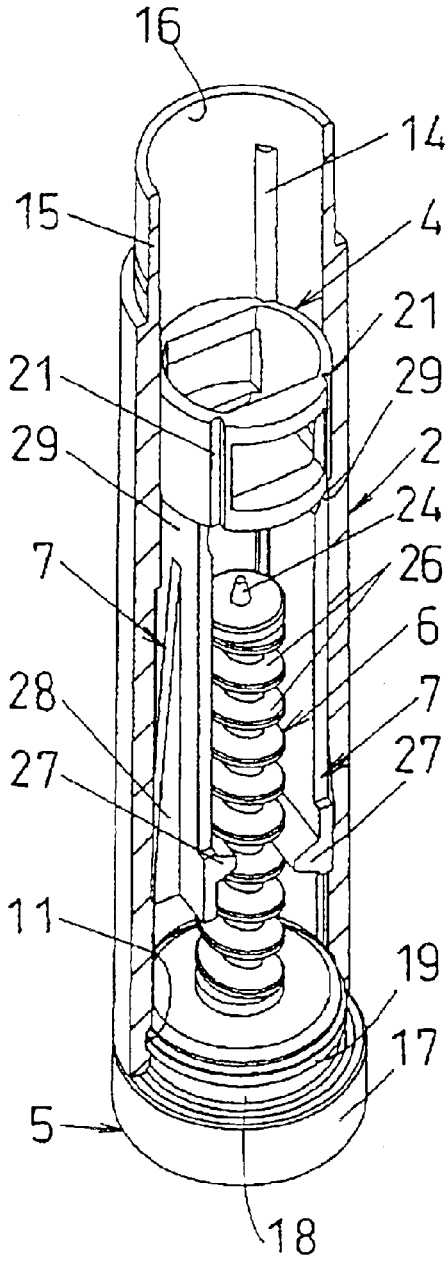
FIG. 14 is a perspective view illustrating a step of assembling the integrally molded rotary member and carrier to the tubular casing.

As a result, as shown in FIG. 11 and FIG. 14, the carrier 4 is forced to move away from the screw shaft 6 to separate the screw shaft 6 and the carrier 4 at the breaking portion 24, and consequently, the contents carrying unit including the carrier 4 and the screw legs 7 are separated from the rotary control unit including the rotary member 5 and the screw shaft 6. Further rotary operations of the rotary member 5 cause the carrier 4 and the screw legs 7, namely, the contents carrying unit, to move axially inside the tubular casing 2 so that they protrude and retract the contents 3 from and into the top end opening 16.

Accordingly, since the carrier 4, the screw legs 7, the rotary member 5, and the screw shaft 6 are integrally formed as a single part, less number of parts are required for constituting the case 1, and consequently less number of molds are needed to form the parts, resulting in a reduced manufacturing cost. And, since the rotary control unit and the contents carrying unit can be assembled to the tubular casing 2 as one part, assembly of the parts is also extremely simplified.

Furthermore, since the screw legs 7 are prevented from rotating by the locking mechanism 22 and the carrier 4 is prevented from rotating by the anti-rotation mechanism 30, a rotary operation of the rotary member 5 is transmitted smoothly to the carrier 4, so that the rotary operation of the rotary member 5 can cause the carrier 4 to slide in the axial direction without a risk of rattling against the tubular casing 2, whereby the contents 3 can be protruded and retracted from and into the tubular casing 2 well.

Thus, it is possible to provide a case 1 in which the contents 3 can be protruded and retracted smoothly from and into the tubular casing 2 by a rotary operation of the rotary member 5 and the number of parts of the case 1 can be reduced for reducing its manufacturing cost as well as simplifying the assembly of the rotary control unit and the contents carrying unit to the tubular casing 2. Further, since the carrier 4, the screw legs 7, the rotary member 5, and the screw shaft 6 are held in the tubular casing 2 as a single part, and moreover, the screw legs 7 are held in a constricted state by elastic deformation, even when the case 1 is subjected to large vibrations or the like at times such as during transportation, the carrier 4, the screw legs 7, the rotary member 5, and the screw shaft 6 do not rattle inside the tubular casing 2, and consequently, unless the rotary member 5 is rotated, there is no risk of an undesired breaking of the breaking portion 24 and its integrity can be surely maintained, advantageously to transportation and storage.

Figure 15:
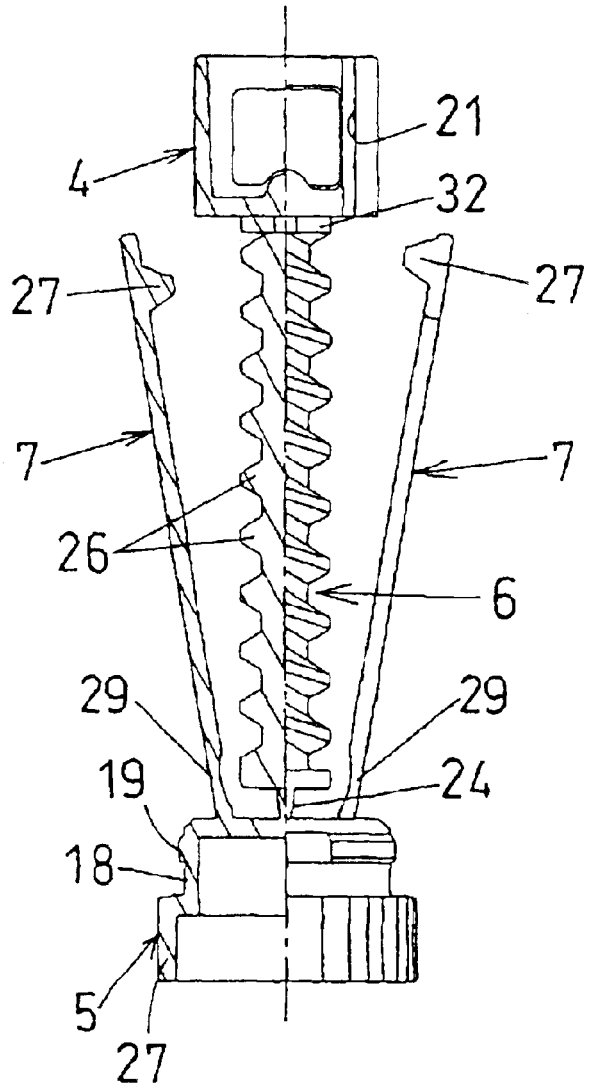
FIG. 15 is a semi-sectional side view of an integrally molded rotary member and carrier illustrating another preferred embodiment.

FIG. 15 shows another preferred embodiment, wherein the screw legs 7 are provided on the rotary member 5; the screw shaft 6 is provided on the carrier 4; the screw shaft 6 is breakably connected to the rotary member 5 through a breaking portion 24; and the rotary member 5, the carrier 4, the screw shaft 6, and a pair of screw legs 7 are molded integrally. In other respects the construction of this preferred embodiment is the same as that of the embodiment described above, and, as in the above described preferred embodiment, a rotary operation of the rotary member 5 causes the contents 3 to be smoothly protruded and retracted from and into the tubular casing 2, the number of parts constituting the case 1 can be reduced for reducing its manufacturing cost as well as simplifying the assembly of the rotary control unit and the contents carrying unit to the tubular casing 2. In this arrangement, since the pair of screw legs 7 rotate with respect to the tubular casing 2 together with the rotary member 5, the anti-rotation mechanism 30 is not needed between the tubular casing 2 and the screw legs 7, accordingly, the engaging projections 28 of the screw legs 7 and the engaging recesses 12 of the tubular casing 2 can be omitted.

Figure 16:
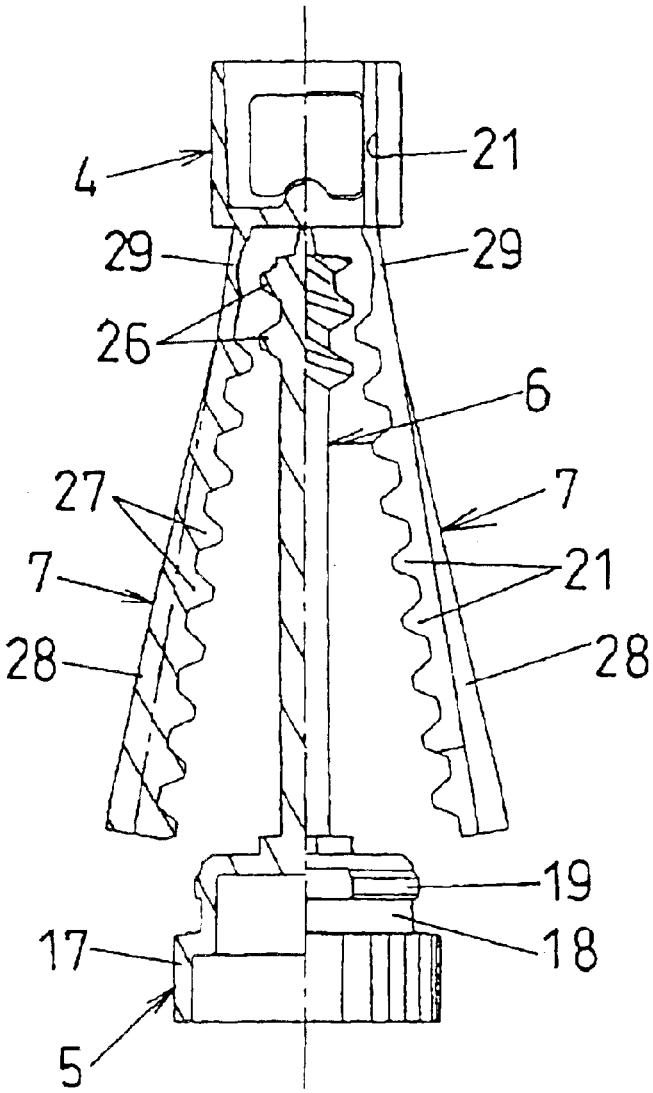
FIG. 16 is a semi-sectional side view of an integrally molded rotary member and carrier illustrating another preferred embodiment.

FIG. 16 shows another preferred embodiment, in which the male thread 26 is provided only on the distal end portion (end portion on the carrier 4 side) of the screw shaft 6, and numerous female threads (thread ribs) 27 are provided along substantially the whole lengths of the inner surfaces of the screw legs 7 (worm and rack type). The rest of the construction is the same as that of the preferred embodiments described above.

Figure 17:
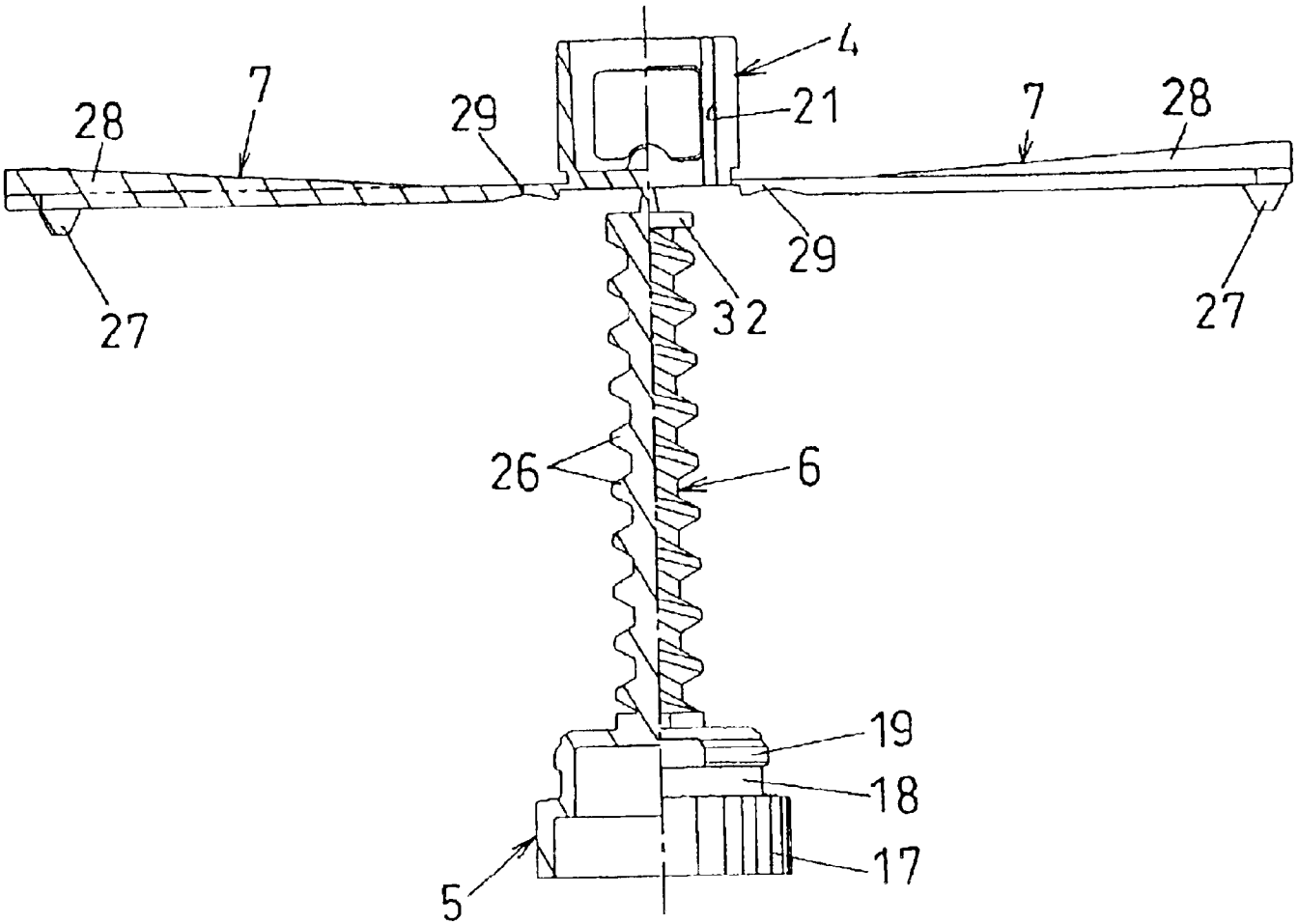
FIG. 17 is a semi-sectional side view of an integrally molded rotary member and carrier illustrating another preferred embodiment.
Figure 18:
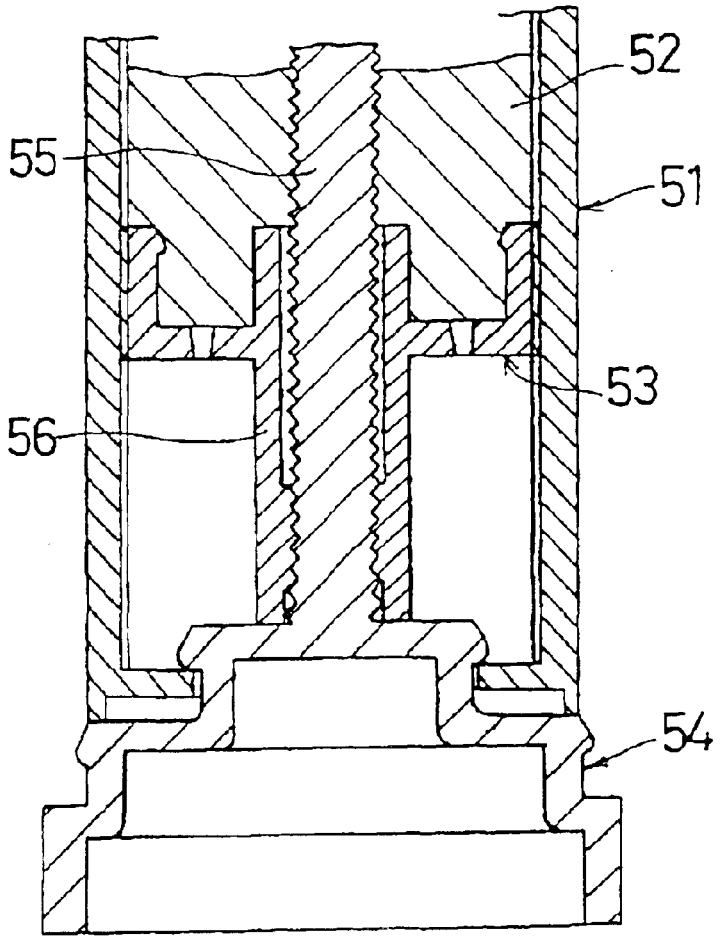
FIG. 18 is a sectional side view showing related art.
Figure 19:
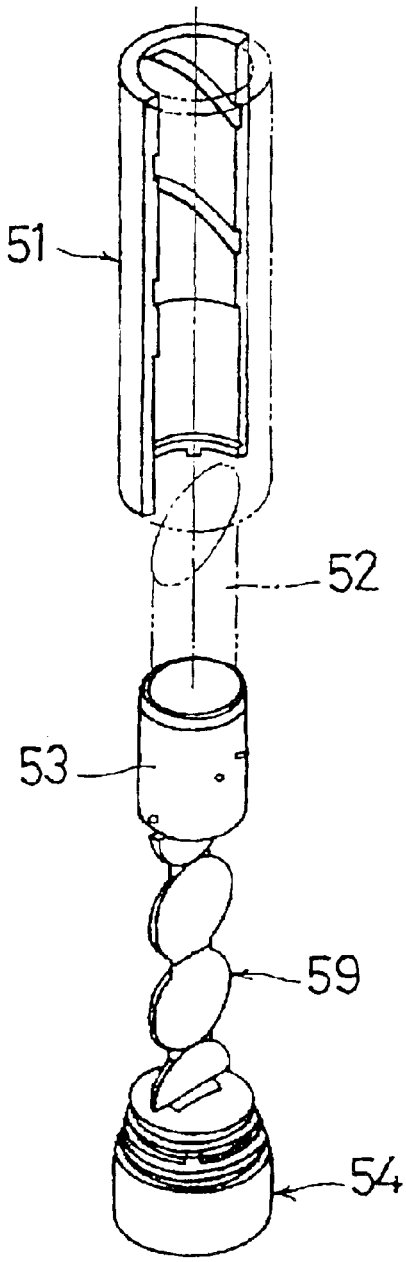
FIG. 19 is a perspective view showing other related art.

FIG. 17 shows another preferred embodiment, in which the pair of screw legs 7 are integrally formed on a side surface of the carrier 4. The rest of the construction is the same as that of the preferred embodiments described above.

It should be noted that the present invention is not limited to the aforementioned embodiments.

Although in the preferred embodiments described above the locking mechanism 22 for preventing the carrier 4 from rotating with respect to the tubular casing 2 consists of guide grooves 21 provided in the outer surface of the carrier 4 and guide ribs 14 provided on the inner circumferential surface of the tubular casing 2, alternatively, guide ribs 14 may be provided on the outer surface of the carrier 4; guide grooves 21 may be provided in the inner circumferential surface of the tubular casing 2; and a locking mechanism 22 for preventing the carrier 4 from rotating with respect to the tubular casing 2 may consists of these guide grooves 21 and guide ribs 14. Further, the tubular casing 2 may be formed in the shape of an elliptical tube or a square tube, and the carrier 4 may be formed in an elliptical or square shape to match the tubular casing 2, so that the carrier 4 may be fitted inside the tubular casing 2 non-rotatably, whereby the guide grooves 21 and the guide ribs 14 provided on the outer surface of the carrier 4 and the inner circumferential surface of the tubular casing 2 can be omitted.

Further, although in the preferred embodiments described above an anti-rotation mechanism 30 for preventing the screw legs 7 from rotating with respect to the tubular casing 2 consists of engaging projections 28 provided on the outer surfaces of the screw legs 7 and engaging recesses 12 provided in the inner surface of the tubular casing 2, alternatively, engaging recesses 12 may be provided in the outer surfaces of the screw legs 7; engaging projections 28 may be provided on the inner surface of the tubular casing 2; and an anti-rotation mechanism 30 for preventing the screw legs 7 from rotating with respect to the tubular casing 2 may be constituted by these engaging recesses 12 and engaging projections 28.

Further, although in the preferred embodiments described above the locking mechanism 22 for preventing the carrier 4 from rotating with respect to the tubular casing 2 is provided between the carrier 4 and the tubular casing 2 and the anti-rotation mechanism 30 for preventing the screw legs 7 from rotating with respect to the tubular casing 2 is provided between the screw legs 7 and the tubular casing 2, alternatively, one of the locking mechanism 22 and the anti-rotation mechanism 30 may be omitted.

Further, although in the preferred embodiments described above a pair of screw legs 7 disposed around the screw shaft 6 is provided on the rotary member 5 or the carrier 4, the number of screw legs 7 provided is not limited to two, and may alternatively be one or three or more.

Further, although in the preferred embodiments described above the carrier 4 is formed in the shape of a cylindrical cup, the shape of the carrier 4 is not limited to this, and of course may alternatively be made some other shape such as a plate shape.

With this invention, a rotary operation of the rotary member 5 can cause the contents 3 to be protruded and retracted smoothly from and into the tubular casing 2, the number of parts constituting the case 1 can be reduced and, hence, its manufacturing cost can be reduced, while at the same time the assembly of the rotary control unit and the contents carrying unit to the tubular casing 2 can be made simple.

What is claimed is:

1. A case comprising: a tubular casing; a contents carrying unit including a carrier movably disposed in the tubular casing; a rotary member unit including a rotary member for moving the carrier in the tubular casing by rotating the rotary member, the rotary member unit and the contents carrying unit being integrally molded with a breaking portion interposed therebetween so that the rotary member unit and the contents carrying unit are broken apart at said breaking portion when the carrier is moved away from the rotary member by rotating the rotary member.

2. A case according to claim 1, wherein one of the rotary member and the carrier is provided with a screw shaft projecting therefrom, and the other is provided with a screw leg projecting therefrom, the screw leg extending beside the screw shaft and having a female thread to be meshed with a male thread formed on the screw shaft, so that when the rotary member is rotated, the screw shaft is rotated with respect to the screw leg, which causes the screw leg to move with respect to the screw shaft in a lengthwise direction of the tubular casing, thereby moving the carrier inside the tubular casing.

3. A case according to claim 2, wherein a plurality of the screw legs are provided around the screw shaft, so that when the screw shaft and the screw legs are inserted into the tubular casing, the screw legs are pressed against the screw shaft so that the female threads of the screw legs are meshed with the male thread of the screw shaft.

4. A case according to claim 2, wherein the screw leg is provided on the rotary member; the screw shaft is provided on the carrier; and the screw shaft is breakably connected to the rotary member through a breaking portion.

5. A case according to claim 4, wherein an anti-rotation mechanism for preventing the screw leg from rotating with respect to the tubular casing is provided between the screw leg and the tubular casing.

6. A case according to claim 5, wherein the anti-rotation mechanism includes an engaging projection provided on one of an outer surface of the screw leg and an inner surface of the tubular casing; and an engaging recess provided on the other, the engaging projection being lengthwisely slidably engaged with the engaging recess so as to prevent the screw leg from rotating with respect to the tubular casing.

7. A case according to claim 2, wherein the screw shaft is provided on the rotary member; the screw leg is provided on the carrier; and the screw shaft is breakably connected to the carrier through a breaking portion.

8. A case according to claim 2, wherein a locking mechanism for preventing the carrier from rotating with respect to the tubular casing is provided between the carrier and the tubular casing.

9. A case according to claim 8, wherein the locking mechanism includes a guide groove provided in one of an outer surface of the carrier and an inner surface of the tubular casing; and a guide rib provided on the other, the guide rib being lengthwisely slidably engaged with the guide groove so as to prevent the carrier from rotating with respect to the tubular casing.

* * * * *